US010570496B2

(12) United States Patent
Umehara et al.

(10) Patent No.: US 10,570,496 B2
(45) Date of Patent: Feb. 25, 2020

(54) NITRIDED OR SOFT NITRIDED PART WITH EXCELLENT WEAR RESISTANCE AND PITTING RESISTANCE, AND NITRIDING AND SOFT NITRIDING METHOD

(71) Applicant: NIPPON STEEL & SUMITOMO METAL CORPORATION, Tokyo (JP)

(72) Inventors: Takahide Umehara, Tokyo (JP); Masato Yuya, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 163 days.

(21) Appl. No.: 15/561,305

(22) PCT Filed: Mar. 24, 2016

(86) PCT No.: PCT/JP2016/059489
§ 371 (c)(1),
(2) Date: Sep. 25, 2017

(87) PCT Pub. No.: WO2016/153009
PCT Pub. Date: Sep. 29, 2016

(65) Prior Publication Data

US 2018/0100226 A1 Apr. 12, 2018

(30) Foreign Application Priority Data

Mar. 25, 2015 (JP) ..... 2015-062803

(51) Int. Cl.

| | |
|---|---|
| ***C23C 8/26*** | (2006.01) |
| ***C21D 9/32*** | (2006.01) |
| ***C21D 1/06*** | (2006.01) |
| ***C21D 1/76*** | (2006.01) |
| ***C23C 8/32*** | (2006.01) |
| ***C22C 38/60*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/18*** | (2006.01) |
| ***C22C 38/20*** | (2006.01) |
| ***C22C 38/22*** | (2006.01) |
| ***C22C 38/24*** | (2006.01) |
| ***C22C 38/40*** | (2006.01) |
| ***C22C 38/42*** | (2006.01) |
| ***C22C 38/44*** | (2006.01) |
| ***C22C 38/46*** | (2006.01) |

(52) U.S. Cl.

CPC ..... *C23C 8/26* (2013.01); *C21D 1/06* (2013.01); *C21D 1/76* (2013.01); *C21D 9/32* (2013.01); *C22C 38/001* (2013.01); *C22C 38/002* (2013.01); *C22C 38/02* (2013.01); *C22C 38/04* (2013.01); *C22C 38/06* (2013.01); *C22C 38/18* (2013.01); *C22C 38/20* (2013.01); *C22C 38/22* (2013.01); *C22C 38/24* (2013.01); *C22C 38/40* (2013.01); *C22C 38/42* (2013.01); *C22C 38/44* (2013.01); *C22C 38/46* (2013.01); *C22C 38/60* (2013.01); *C23C 8/32* (2013.01)

(58) Field of Classification Search

CPC ..... C23C 8/26; C22C 38/001
See application file for complete search history.

(56) References Cited

U.S. PATENT DOCUMENTS

| | | | | |
|---|---|---|---|---|
| 6,093,263 | A | 7/2000 | Kobayashi et al. | |
| 2008/0000553 | A1* | 1/2008 | Sano | C21D 9/30 148/318 |
| 2014/0060983 | A1 | 3/2014 | Sugai et al. | |
| 2014/0251507 | A1 | 9/2014 | Mizuno et al. | |
| 2015/0053311 | A1 | 2/2015 | Shimizu et al. | |

FOREIGN PATENT DOCUMENTS

| | | | |
|---|---|---|---|
| JP | 7-179985 | A | 7/1995 |
| JP | 7-190173 | A | 7/1995 |
| JP | 8-165556 | A | 6/1996 |
| JP | 8-165557 | A | 6/1996 |
| JP | 11-72159 | A | 3/1999 |
| JP | 2002-69609 | A | 3/2002 |
| JP | 2013-221203 | A | 10/2013 |
| JP | 2014-118583 | A | 6/2014 |
| JP | 5669979 | B1 | 2/2015 |
| KR | 10-2011-0095955 | A | 8/2011 |
| WO | WO 2016/024923 | A1 | 2/2016 |

OTHER PUBLICATIONS

Korean Office Action, dated Oct. 1, 2018, for corresponding Korean Application No. 10-2017-7026218, along with an English translation.

International Search Report (form PCT/ISA/210), dated May 10, 2016, for International Application No. PCT/JP2016/059489, with English translation.

* cited by examiner

*Primary Examiner* — Jessee R Roe

(74) *Attorney, Agent, or Firm* — Birch, Stewart, Kolasch & Birch, LLP

(57) ABSTRACT

A nitrided part and soft nitrided part with excellent wear resistance and pitting resistance and a nitriding method and soft nitriding method are provided, specifically, a nitrided part or soft nitrided part made by a steel material comprising, by mass %, C: 0.05 to 0.3%, Si: 0.05 to 1.5%, Mn: 0.2 to 1.5%, P: 0.025% or less, S: 0.003 to 0.05%, Cr: 0.5 to 2.0%, Al: 0.01 to 0.05%, and N: 0.003 to 0.025% and having a balance of Fe and impurities, wherein, the surface layer comprises a compound layer containing iron, nitrogen, and carbon and a nitrogen diffusion layer positioned below the compound layer, the compound layer comprises an ε single phase, the ε single phase has a thickness of 8 to 30 μm and a Vicker's hardness of 680 HV or more, and the ε single phase has a volume ratio of pores of less than 10%.

13 Claims, 1 Drawing Sheet

NITRIDED OR SOFT NITRIDED PART WITH EXCELLENT WEAR RESISTANCE AND PITTING RESISTANCE, AND NITRIDING AND SOFT NITRIDING METHOD

TECHNICAL FIELD

The present invention relates to a part produced by gas nitriding or gas soft nitriding, in particular a part in which wear resistance and pitting resistance are demanded such as a CVT pulley or gear, and a method of gas nitriding and gas soft nitriding used in production of these parts.

BACKGROUND ART

Steel parts used in automobiles and various industrial machinery etc. are sometimes required to have fatigue strength at their surfaces. For example, in CVT pulleys for transmissions, wear resistance is demanded, while in gears, the fatigue characteristic of pitting resistance is demanded. For improvement of these characteristics, improvement of the surface hardness of the steel parts is considered effective. For steel materials, nitriding and soft nitriding are being increasingly applied. Nitriding and soft nitriding of steel materials are advantageous in that a high surface hardness is obtained and heat treatment strain is small.

Nitriding is a method of treatment that diffuses nitrogen into the surface of a steel material, while soft nitriding is treatment that diffuses nitrogen and carbon into the surface of the steel material. As the medium used for the nitriding and soft nitriding, there are gases, salt baths, plasma, etc. The transmission parts of automobiles are mainly treated by the excellent productivity gas nitriding and gas soft nitriding.

The hardened layer formed by the gas nitriding and gas soft nitriding is comprised of a nitrogen diffusion layer and a compound layer formed at the surface side from the nitrogen diffusion layer and of a thickness of several μm to several tens of μm. The nitrogen diffusion layer is a layer hardened by diffused nitrogen, solid-solution strengthening by carbon, and the particle dispersion strengthening mechanism of nitrides. It is known that improvement of the hardness and depth of the nitrogen diffusion layer gives rise to an improvement in the pitting resistance. In the past, therefore much research has been conducted into improvement of the hardness and depth of the diffusion layer. The compound layer is comprised of an ε phase mainly made of $Fe_{2-3}N$ and also containing carbon or a γ' phase mainly made of $Fe_4N$. Compared with a steel material, the hardness is extremely high. When the compound layer is formed, the wear resistance is improved.

As conventional findings relating to the compound layer and wear resistance, the following may be mentioned. PLT 1 proposes a gear part which has been nitrided or carbonitrided, has a content of nitrogen from at least the surface down to a depth of 150 μm of 0.2 to 0.8%, has a quenched hardened layer of a mixed structure of martensite and 10 to 40% of residual austenite, and has excellent pitting resistance and wear resistance. PLT 1 has a description relating to the nitrogen content at the steel surface, but has no description relating to the components, composition, and properties of a compound layer formed by nitriding.

Further, PLT 2 proposes a method of treatment using a mixed gas with a residual concentration of $NH_3$ of 45 to 65 vol % for soft nitriding at a gas temperature of 530 to 565° C. for 2 hours to thereby form a compound layer of a thickness of 2 to 12 μm containing pores and improve the pitting resistance, wear resistance, etc. The compound layer described in PLT 2 is comprised of $Fe_3N$ (ε), $Fe_4N$ (γ'), etc.

CITATION LIST

Patent literature

PLT 1: Japanese Patent Publication No. 7-190173A
PLT 2: Japanese Patent Publication No. 11-72159A

SUMMARY OF INVENTION

Technical Problem

In the above-mentioned PLT 1, a part with excellent pitting resistance and wear resistance is proposed. However, surface hardening by quenching is utilized, so compared with a normal nitrided and soft nitrided part, the heat treatment strain is large and the cost of the later grinding process swells.

In PLT 2, the thickness of the compound layer was considered, but the pores were not optimized. For this reason, sometimes this cannot be applied to parts where high pitting strength is required.

The arts disclosed on the above-mentioned PLTs 1 and 2, as shown in the examples, are arts able to improve the wear resistance, pitting resistance, and other fatigue characteristics. However, the effects of the components, composition, and properties of the compound layer on the wear resistance and pitting resistance have not been studied.

The object of the present invention is to provide a part with excellent wear resistance and pitting resistance which enables demands for reducing the size and lightening the weight of parts and high load capacity to be met. Furthermore, as the means for the same, it also provides the methods of gas nitriding and gas soft nitriding optimally controlling the components and composition of the compound layer.

Solution to Problem

The components, composition, and thickness of the compound layer can be controlled by the treatment temperature and the nitriding potential ($K_N$) defined by the following formula:

$$K_N=(NH_3 \text{ partial pressure})/[(H_2 \text{ partial pressure})^{3/2}] \quad \text{(formula 1)}$$

However, the art of controlling the $NH_3$ and $N_2$ atmosphere in a production scale nitriding furnace has only been established in recent years, so there are still few findings regarding the components, composition, and properties of compound layers of actually produced parts.

Therefore, the inventors controlled the $K_N$ to change the compound layer in various ways and investigate the relationship of the compound layer and the wear resistance. As a result, they discovered that the improvement of the wear resistance is affected by the components, composition, thickness, and hardness of the compound layer and further is affected by the volume ratio of the cavities formed by the atomic state nitrogen diffusing into the steel during the nitriding becoming $N_2$ molecules and being released from the steel (below, called "pores").

Details of the obtained discoveries are summarized in the following (a) to (e):

(a) The compound layer formed by gas nitriding or gas soft nitriding is either of a γ' single phase, ε single phase, and γ'+ε phase. The ε phase is higher in hardness than the γ' phase, so to raise the wear resistance, it is effective to make the compound layer which is formed a single phase of the ε phase. The ε phase is formed in the higher $K_N$ region than the γ' phase, so there is a need to set a lower limit of $K_N$. Further, by raising the amount of carbon in the steel or performing soft nitriding, an ε single phase is easily obtained.

(b) The ε phase becomes harder the greater the carbon and nitrogen contents. For this reason, to raise the wear resistance of the ε phase, raising the amounts of carbon and nitrogen in the ε phase is effective. For this reason, it is necessary to raise the amount of carbon of the steel serving as the source of supply of the carbon and employ soft nitriding diffusing carbon so as to further perform nitriding/soft nitriding in the high $K_N$ region and raise the amount of nitrogen in the ε phase.

(c) If the thickness of the compound layer increases, pores are formed and the wear resistance and pitting strength fall. For this reason, it is necessary to suitably control the thickness of the compound layer. Specifically, the thickness of the compound layer becomes greater the higher the $K_N$, so it is necessary to provide an upper limit of the $K_N$.

(d) In actual gas nitriding, it is difficult to continue to hold the furnace gas atmosphere constant. For this reason, it is necessary to set a range of the $K_N$ value where a compound layer satisfying the above (a) to (c) is obtained. On the other hand, right after the start of treatment, the atmosphere becomes particularly unstable. It tends to take about 50 minutes until it stabilizes. For this reason, at minutes 0 to 50 after start of treatment, it is necessary to satisfy the above (a) to (c) and, considering the fact that the atmosphere is unstable, set the range of control of the $K_N$ value broader.

Furthermore, the following findings were obtained regarding the effect of the nitrogen diffusion layer on the pitting resistance and the wear resistance.

(e) If there are Mn, Cr, or other nitride forming elements in the steel, the nitrogen diffusion layer changes in hardness and diffusion layer depth. The pitting resistance is improved the higher the diffusion layer hardness and, further, the deeper the diffusion layer, so it becomes necessary to set the optimum ranges of the components of the steel material.

(f) The nitrogen diffusion layer is lower in wear resistance than the compound layer, so if the compound layer is worn away, wear proceeds faster.

Therefore, to improve the wear resistance and pitting resistance of a part utilizing gas nitriding and gas soft nitriding, it is necessary to control the $K_N$ and amount of C in the steel to control the amount of carbon and nitrogen in the compound layer and form a compound layer having few pores and having an ε single phase of a suitable thickness and hardness and adjust the steel components to increase the thickness of the nitrogen diffusion layer.

Note that, to evaluate the pores quantitatively, a SEM image of the compound layer was used, 50 μm line segments parallel to the surface were drawn every 2 μm from the surfacemost part to the bottommost part of the compound layer, the average value of the rates of the lengths of the pore parts in the line segments was calculated, and this was defined as the "pore volume ratio (%)". Further, the evaluated value of the compound layer hardness was made the average value of 10 random points of the compound layer measured using a Microvicker's hardness meter at a load of $9.8\times10^{-2}$N.

The present invention was completed based on the above discoveries and has as its gist the gas nitrided part and gas soft nitrided part shown in the following (1) to (4):

(1) A nitrided part or soft nitrided part made of a steel material comprising, by mass %, C: 0.05 to 0.3%,
Si: 0.05 to 1.5%,
Mn: 0.2 to 1.5%,
P: 0.025% or less,
S: 0.003 to 0.05%,
Cr: 0.5 to 2.0%,
Al: 0.01to 0.05%, and
N: 0.003 to 0.025% and
having a balance of Fe and impurities,
wherein,
the surface layer comprises a compound layer containing iron, nitrogen, and carbon and a nitrogen diffusion layer positioned below the compound layer,
the compound layer comprises an ε single phase,
the ε single phase has a thickness of 8 to 30 μm and a Vicker's hardness of 680 HV or more, and
the ε single phase has a volume ratio of pores of less than 10%.

(2) The nitrided part or soft nitrided part according to (1), further containing, by mass %, one or both of Mo: 0.01to less than 0.50% and V: 0.01 to less than 0.50%.

(3) The nitrided part or soft nitrided part according to (1) or (2), further containing, by mass %, one or both of Cu: 0.01 to less than 0.50% and Ni: 0.01 to less than 0.50%.

(4) The nitrided part or soft nitrided part according to any one of (1) to (3) wherein the compound layer includes, by atm %, (C+N)=22% or more.

(5) A method of nitriding a part comprising a steel material having the components according to any one of (1) to (3), comprising heating the part in a gas atmosphere comprising $NH_3$, $H_2$, and $N_2$ to 550 to 620° C. for 1.0 to 10 hours, wherein a nitriding potential $K_N$ obtained by the following (formula 1) is 0.3 to 2.0 in minute 0 to 50 in the nitriding time and is 0.70 to 1.50 from minute 50 on:

$$K_N=(NH_3 \text{ partial pressure})/[(H_2 \text{ partial pressure})^{3/2}] \quad \text{(formula 1)}$$

(6) A method of soft nitriding a part comprising a steel material having the components according to any one of (1) to (3), comprising heating the part in a gas atmosphere comprising $NH_3$, $H_2$, $N_2$, and $CO_2$ to 550 to 620° C. for 1.0 to 10 hours, wherein a nitriding potential $K_N$ obtained by the following (formula 1) is 0.3 to 2.0 in minute 0 to 50 in the soft nitriding time and is 0.70 to 1.50 from minute 50 on:

$$K_N=(NH_3 \text{ partial pressure})/[(H_2 \text{ partial pressure})^{3/2}] \quad \text{(formula 1)}$$

Advantageous Effects of Invention

The nitrided part and soft nitrided part of the present invention are excellent in wear resistance and pitting resistance, so can be utilized for the gears, CVT pulleys, transmission parts, etc. of automobiles and industrial machines.

DESCRIPTION OF EMBODIMENTS

Figure 1:
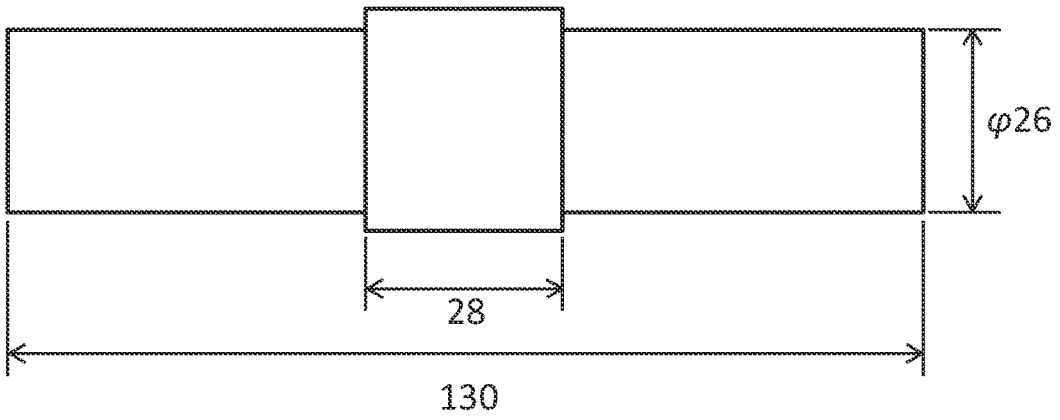
FIG. 1 is a view showing the shape of a small roller used for a roller pitting test. Note that the units of the dimensions ϕ26, 28, and 130 in the figure are "mm".

Below, the requirements of the present invention will be explained in detail. Note that the "%" showing the contents of the components of the elements in the steel material used as the material and the concentration of elements at the surfaces of the parts means "mass %".

(A) Regarding Chemical Composition of Steel Material Used as Material

C: 0.05 to 0.3%

C is an element required for securing the core strength of the part and the hardness of the compound layer. If the content of C is less than 0.05%, the result does not become the ε phase single phase harder than the γ' phase and excellent in wear resistance. Further, if the content of C is over 0.3%, the steel rod or wire used as the material or the steel rod or wire after hot forging becomes too high in strength, so the machineability greatly fails. The preferable range of the content of C is 0.08 to 0.25%.

Si: 0.05 to 1.5%

Si raises the core hardness of a part by solid-solution strengthening. Further, the quenching softening resistance is raised and the pitting strength of the part surface becoming a high temperature under wear conditions is raised. To obtain these effects, 0.05% or more is included. On the other hand, if the content of Si is over 1.5%, the steel rod or wire used as the material or the steel rod or wire after hot forging becomes too high in strength, so the machineability greatly falls. The preferable range of the content of Si is 0.08 to 1.2%.

Mn: 0.2 to 1.5%

Mn raises the core hardness of the part by solid-solution strengthening. Furthermore, Mn forms fine nitrides ($Mn_3N_2$) at the time of nitriding and improves the wear resistance and pitting resistance by precipitation strengthening. To obtain these effects, the Mn has to be 0.2% or more. On the other hand, if the content of Mn is over 1.5%, not only does the effect of raising the pitting strength become saturated, but also the steel rod or wire used as the material or the steel rod or wire after hot forging becomes too high in hardness, so the machineability greatly falls. The preferable range of the Mn content is 0.4 to 1.2%.

P: 0.025% or less

The impurity P segregates at the grain boundaries and causes the parts to become brittle. For this reason, if the content of P exceeds 0.025%, sometimes the bending fatigue strength falls. The preferable upper limit of the P content for preventing a drop in the bending fatigue strength is 0.018%.

S: 0.003 to 0.05%

S bonds with Mn to form MnS and improve the machineability. However, if the content is less than 0.003%, the effect of improvement of the machineability is difficult to obtain. On the other hand, if the content of S increases, coarse MnS becomes easier to form. In particular, if the content is over 0.05%, the fall in surface fatigue strength becomes remarkable. The preferable range of the S content is 0.01 to 0.03%.

Cr: 0.5 to 2.0%

Cr forms fine nitrides (CrN) at the time of nitriding and improves the wear resistance and pitting resistance by precipitation strengthening. To obtain these effects, Cr has to be 0.5% or more. On the other hand, if the content of Cr exceeds 2.0%, not only does the effect of raising the pitting strength become saturated, but also the steel rod or wire used as the material or the steel rod or wire after hot forging becomes too high in hardness, so the machineability remarkably falls. The preferable range of the Cr content is 0.7 to 1.8%.

Al: 0.01 to 0.05%

Al is a deoxidizing element. For sufficient deoxidation, 0.01% or more is necessary. On the other hand, Al easily forms hard oxide-type inclusions. If the content of Al exceeds 0.05%, the drop in the bending fatigue strength becomes remarkable, so even other requirements are satisfied, the desired bending fatigue strength can no longer be obtained. The preferable range of the Al content is 0.02 to 0.04%.

N: 0.003 to 0.025%

N bonds with Al and V to form AlN and VN. AlN and VN have the effect of suppressing the formation of coarse particles due to the pinning action and reduces the variation in mechanical properties. If the content of N is less than 0.003%, the effect cannot be obtained. On the other hand, if the content of N is over 0.025%, coarse AlN more easily forms, so the above effect cannot be obtained. The preferable range of the N content is 0.005 to 0.020%.

The following are optional elements.

Mo: 0.01 to less than 0.50%

Mo forms fine nitrides ($Mo_2N$) at the time of nitriding and soft nitriding and improves the wear resistance and pitting resistance by precipitation strengthening. Further, Mo has the action of age hardening at the time of nitriding to improve the core hardness of a part. To obtain these effects, the Mo content is preferably 0.01% or more. On the other hand, the content of Mo is 0.50% or more, the steel rod or wire used as the material or the steel rod or wire after hot forging becomes too high in hardness, so the machineability remarkably falls. Further, the alloy cost increases. The preferable upper limit of the Mo content for securing machineability is less than 0.40%.

V: 0.01 to less than 0.50%

V forms fine nitrides (VN) at the time of nitriding and soft nitriding and improves the wear resistance and pitting resistance by precipitation strengthening. Further, V has the action of age hardening at the time of nitriding to improve the core hardness of a part. To obtain these actions, the V content is preferably 0.01% or more. On the other hand, the content of V is 0.50% or more, the steel rod or wire used as the material or the steel rod or wire after hot forging becomes too high in hardness, so the machineability remarkably falls. Further, the alloy cost increases. The preferable range of the V content for securing machineability is less than 0.40%.

Cu: 0.01 to 0.50%

Cu acts as a solid-solution strengthening element to improve the core hardness of a part and the hardness of the nitrogen diffusion layer. To obtain the action of solid-solution strengthening of Cu, a content of 0.01% or more is preferable. On the other hand, if the content of Cu is over 0.50%, the steel rod or wire used as the material or the steel rod or wire after hot forging becomes too high in hardness, so the machineability remarkably falls. Further, the hot ductility falls, so causes the formation of surface defects at the time of hot rolling and the time of hot forging. The preferable range of the Cu content for maintaining the hot ductility is less than 0.40%.

Ni: 0.01 to 0.50%

Ni improves the core hardness and surface layer hardness of a part by solid-solution strengthening. To obtain the action of solid-solution strengthening by Ni, a content of 0.01% or more is preferable. On the other hand, if the content of Ni exceeds 0.50%, the steel rod or wire used as the material or the steel rod or wire after hot forging becomes too high in hardness, so the machineability remarkably falls. Further, the alloy cost increases. To obtain sufficient machineability, the preferable range of the Ni content is less than 0.40%.

(B) Gas Nitriding and Gas Soft Nitriding Temperature

When making the temperature of the gas nitriding (nitriding temperature) less than 550° C., the speed of nitrogen diffusion in the steel becomes smaller, so a sufficient thickness of the hardened layer (nitrogen diffusion layer or compound layer) cannot be obtained. Further, if performing gas nitriding at a temperature of over 620° C., the material transforms to an austenite phase (γ phase) with a smaller speed of diffusion of nitrogen than a ferrite phase (α phase), so it becomes difficult to obtain the thickness of the nitrogen diffusion layer. For this reason, in the present invention, the treatment temperature of the gas nitriding is made 550 to 620° C.

(C) Gas Nitriding and Gas Soft Nitriding Time

The time from the start to the end of the nitriding (nitriding time) has an effect on the thickness of the compound layer and depth of the nitrogen diffusion layer. If the treatment time is shorter than 1.0 hour, the diffusion layer becomes smaller in depth and the pitting resistance falls. If over 10 hours, not only does the pore ratio increase and the wear resistance fall, but also an increase in the manufacturing cost is incurred. For this reason, the treatment time is made 1.0 to 10 hours.

(D) $K_N$ Control During Gas Nitriding and Gas Soft Nitriding

In the present invention, gas nitriding uses an atmosphere comprised of $NH_3$, $H_2$, and $N_2$, while gas soft nitriding uses an atmosphere comprised of $NH_3$, $H_2$, $N_2$, and $CO_2$. The nitriding potential $K_N$ controls the flow rate of $NH_3$ and flow rate of $N_2$ to adjust this. To form a compound layer comprised of only the ε phase, the range of $K_N$ during the treatment is adjusted to become 0.3 to 2.0 at minute 0 to 50 in the treatment time and to become 0.70 to 1.50 from minute 50 on. If $K_N$ is smaller than 0.3 at minute 0 to 50 in the treatment time or if it is smaller than 0.70 after minute 50, the thickness of the compound layer becomes less than 8 μm or the concentration of (C+N) in the compound layer becomes less than 22 atm %, and the γ' phase is mixed in. As a result, the wear resistance falls. On the other hand, if $K_N$ exceeds the prescribed upper limit value of 1.50, the thickness of the ε phase becomes larger than 30 μm. Further, the porosity sometimes becomes 10% or more.

To control the $K_N$ for nitriding, for example, there is the method of seasoning the part, before nitriding, by holding the inside of the furnace in a high $NH_3$ atmosphere, then adjusting the flows of $NH_3$, $H_2$, and $N_2$ to give the target $K_N$, while for gas soft nitriding, further adjusting the flow of $CO_2$, then introducing the part into a furnace. However, the method of control of $K_N$ of the present invention is not limited to this.

Note that, the atmosphere for performing gas nitriding and gas soft nitriding sometimes includes oxygen or other unavoidable impurities. In gas nitriding, the total of $NH_3$, $H_2$, and $N_2$, while in gas soft nitriding, the total of $NH_3$, $H_2$, $N_2$, and $CO_2$ is preferably made 99.5% (vol %) or more.

(E) Identification of Compound Layer

The compound layer of the gas nitrided part and gas soft nitrided part according to the present invention is an ε single phase. To discriminate among the phases, for example, EBSD (Electron BackScatter Diffraction) attached to an SEM (scan type electron microscope) can be used. In the present invention, the crystal orientation is measured by EBSD. The case where the region where the confidence index (CI value) of $Fe_{2-3}N$ in the compound layer is less than 0.05 is less than 10% is deemed as the ε single phase.

(F) Hardness of Compound Layer

The gas nitrided part and gas soft nitrided part according to the present invention have average hardnesses of the compound layers of 680 HV or more.

It is known that the wear resistance greatly depends on the hardness of the part from the surface down to several tens of μm. The inventors measured the Vicker's hardness of the compound layer based on "Vicker's Hardness Test—Test Method" described in JIS Z 2244 (2003).

The inventors compared and studied the results of a wear test using a roller pitting test machine. As a result, it became clear that to make the depth of wear after a repeated $2\times10^6$ cycles at a surface pressure of 1600 MPa 15 μm or less, the compound layer has to be 680 HV or more in hardness, (G) Volume Ratio of Pores in Compound Layer The gas nitrided part and gas soft nitrided part according to the present invention have volume ratios of pores in the compound layers of less than 10%. Test pieces formed with various compound layers were evaluated for wear resistance characteristics by a roller pitting test. As a result, with a volume ratio of pores of 10% or more, the amount of wear exceeded the target value of 15 μm.

(H) Ratios of Components in Compound Layer

The gas nitrided part and gas soft nitrided part according to the present invention have (C+N) concentrations in the compound layer of 22 atm % or more. Test pieces formed with various compound layers were evaluated for wear resistance characteristics by a roller pitting test. As a result, with a concentration of (C+N) of less than 22 atm %, the amount of wear failed satisfy the target value of 15 μm or less.

EXAMPLE 1

Steels "a" to "z" having the chemical components shown in Table 1 were melted in a 50 kg vacuum melting furnace, then were cast to form ingots. Note that, in Table 1, "a" to "q" are steels having the chemical components prescribed in the present invention. On the other hand, the steels "s" to "z" are steels of comparative examples with at least one or more elements outside the chemical components prescribed in the present invention.

TABLE 1

| | Chemical components (mass %)*1 | | | | | | | | | | | | |
|---|---|---|---|---|---|---|---|---|---|---|---|---|---|
| Steel | C | Si | Mn | P | S | Cr | Al | N | Mo | V | Cu | Ni | Remarks |
| a | 0.20 | 0.80 | 0.58 | 0.015 | 0.020 | 0.84 | 0.028 | 0.008 | | | | | Inv. |
| b | 0.11 | 0.70 | 0.52 | 0.018 | 0.018 | 1.00 | 0.046 | 0.023 | | | | | ex. |
| c | 0.08 | 0.70 | 0.51 | 0.023 | 0.040 | 1.46 | 0.023 | 0.004 | | | | | |
| d | 0.06 | 0.67 | 0.45 | 0.012 | 0.019 | 1.54 | 0.028 | 0.005 | | | | | |
| e | 0.09 | 0.96 | 1.33 | 0.017 | 0.019 | 0.71 | 0.033 | 0.006 | | | | | |
| f | 0.15 | 1.15 | 0.44 | 0.017 | 0.029 | 1.94 | 0.027 | 0.018 | | | | | |
| g | 0.16 | 0.20 | 1.54 | 0.014 | 0.014 | 0.90 | 0.052 | 0.007 | 0.20 | | | | |
| h | 0.11 | 1.31 | 0.49 | 0.008 | 0.013 | 1.24 | 0.012 | 0.003 | 0.32 | | | | |

TABLE 1-continued

| Steel | Chemical components (mass %)*1 | | | | | | | | | | | | Remarks |
|---|---|---|---|---|---|---|---|---|---|---|---|---|---|
| | C | Si | Mn | P | S | Cr | Al | N | Mo | V | Cu | Ni | |
| i | 0.24 | 1.02 | 0.70 | 0.018 | 0.014 | 0.81 | 0.030 | 0.009 | | | 0.23 | | |
| j | 0.22 | 0.52 | 0.64 | 0.017 | 0.018 | 1.01 | 0.022 | 0.010 | | | | 0.24 | |
| k | 0.25 | 0.80 | 0.45 | 0.016 | 0.023 | 1.22 | 0.009 | 0.011 | | 0.21 | | | |
| l | 0.27 | 0.42 | 0.64 | 0.014 | 0.020 | 0.61 | 0.018 | 0.015 | 0.25 | | 0.11 | | |
| m | 0.18 | 0.25 | 1.50 | 0.013 | 0.016 | 0.77 | 0.023 | 0.018 | | | 0.07 | 0.05 | |
| n | 0.29 | 0.09 | 0.75 | 0.011 | 0.011 | 0.77 | 0.029 | 0.019 | | 0.13 | | 0.15 | |
| o | 0.13 | 0.06 | 1.18 | 0.009 | 0.010 | 0.57 | 0.039 | 0.020 | 0.08 | 0.14 | | | |
| p | 0.18 | 0.08 | 0.55 | 0.008 | 0.016 | 0.89 | 0.048 | 0.024 | | 0.15 | 0.10 | 0.07 | |
| q | 0.12 | 0.10 | 1.18 | 0.024 | 0.002 | 0.76 | 0.039 | 0.011 | 0.09 | 0.13 | 0.12 | 0.20 | |
| r | 0.16 | 0.02 | 0.45 | 0.016 | 0.016 | 0.71 | 0.030 | 0.012 | | | | | Comp. |
| s | 0.12 | 1.10 | 0.17 | 0.009 | 0.031 | 0.88 | 0.021 | 0.014 | | | | | ex. |
| t | 0.20 | 0.90 | 0.55 | 0.060 | 0.018 | 0.83 | 0.027 | 0.016 | | | | | |
| u | 0.21 | 0.83 | 0.85 | 0.012 | 0.021 | 0.40 | 0.029 | 0.009 | | | | | |
| v | 0.01 | 0.74 | 0.70 | 0.009 | 0.009 | 0.79 | 0.033 | 0.011 | | | | | |
| w | 0.13 | 0.41 | 0.42 | 0.016 | 0.092 | 0.90 | 0.037 | 0.014 | | | | | |
| x | 0.09 | 0.99 | 0.18 | 0.006 | 0.033 | 0.45 | 0.028 | 0.017 | 0.20 | | | | |
| y | 0.08 | 0.53 | 1.05 | 0.007 | 0.015 | 1.78 | 0.060 | 0.009 | | | | | |
| z | 0.01 | 0.40 | 1.80 | 0.010 | 0.014 | 0.93 | 0.027 | 0.018 | | | | | |

*1Balance of chemical components is Fe and impurities.
*2. Empty fields show no alloy elements intentionally added.
*3. Underlines indicate outside scope of present invention.

Each ingot was hot forged to a diameter 35 mm rod. Next, each rod was annealed, then machined to fabricate a plate-shaped test piece for evaluation of the type, thickness, hardness, and volume ratios of pores of the compound layer. The plate-shaped test piece was made a vertical 20 mm, horizontal 20 mm, and depth 2 mm one. Further, a small roller for roller pitting test use was fabricated for evaluating the wear depth and pitting strength. The small roller had a diameter of 26 mm and a length of 130 mm.

Next, gases of $NH_3$, $H_2$, $N_2$ (and, in case of gas soft nitriding, $CO_2$) were introduced into the gas nitriding furnace. The part was gas nitrided and gas soft nitrided under the conditions shown in Table 2, then was oil cooled using 80° C. oil. In the gas nitriding and gas soft nitriding, the $H_2$ partial pressure in the atmosphere was measured using a heat conducting type $H_2$ sensor directly attached to the gas nitriding furnace. The difference in heat conductivity between the standard gas and measured gas was measured converted to the gas concentration. The $H_2$ partial pressure was measured continuously during the gas nitriding. Further, the $NH_3$ partial pressure was measured with a manual glass tube type $NH_3$ analysis meter attached to the outside of the furnace. At the same time as measuring the partial pressure of the residual $NH_3$ every 10 minutes, the nitriding potential $K_N$ was calculated and the flow rate of $NH_3$ and flow rate of $N_2$ were adjusted to make it converge to the target value. The nitriding potential $K_N$ was calculated every 10 minutes of measurement of the $NH_3$ partial pressure and the flow rate of $NH_3$ and flow rate of $N_2$ were adjusted to make it converge to the target value.

TABLE 2

| Test no. | Steel | Nitriding/soft nitriding: Temp. (° C.) | Time (h) | Amount of addition of $CO_2$ (%) | Nitriding potential Kn: 0 to 50 min Lower limit | 0 to 50 min Upper limit | 50 min up Lower limit | 50 min up Upper limit | Type of compound layer |
|---|---|---|---|---|---|---|---|---|---|
| 1 | a | 590 | 5 | | 0.60 | 1.80 | 0.80 | 1.35 | ε |
| 2 | a | 590 | 5 | | 0.65 | 1.80 | 0.85 | 1.45 | ε |
| 3 | a | 590 | 5 | | 0.80 | 1.95 | 1.00 | 1.50 | ε |
| 4 | a | 590 | 5 | | 0.70 | 1.75 | 0.90 | 1.25 | ε |
| 5 | a | 590 | 5 | 3 | 0.90 | 1.70 | 1.10 | 1.45 | ε |
| 6 | a | 590 | 5 | 3 | 0.90 | 1.80 | 1.10 | 1.40 | ε |
| 7 | a | 590 | 5 | 3 | 0.85 | 1.70 | 1.05 | 1.45 | ε |
| 8 | a | 590 | 5 | | 0.75 | 1.60 | 0.95 | 1.45 | ε |
| 9 | a | 590 | 5 | | 0.65 | 1.65 | 0.85 | 1.40 | ε |
| 10 | b | 590 | 5 | | 0.60 | 1.70 | 0.80 | 1.35 | ε |
| 11 | c | 590 | 3 | | 0.65 | 1.75 | 0.85 | 1.35 | ε |
| 12 | d | 590 | 5 | 3 | 0.70 | 1.75 | 0.90 | 1.40 | ε |
| 13 | e | 590 | 5 | 3 | 0.80 | 1.90 | 1.00 | 1.35 | ε |
| 14 | f | 590 | 3 | | 0.60 | 1.65 | 0.80 | 1.25 | ε |
| 15 | g | 590 | 5 | | 0.65 | 1.75 | 0.85 | 1.30 | ε |
| 16 | h | 590 | 3 | | 0.65 | 1.80 | 0.85 | 1.30 | ε |
| 17 | i | 590 | 5 | | 0.60 | 1.50 | 0.80 | 1.25 | ε |
| 18 | j | 590 | 5 | 3 | 0.90 | 1.70 | 1.10 | 1.30 | ε |
| 19 | k | 590 | 5 | | 0.75 | 1.55 | 0.95 | 1.25 | ε |
| 20 | l | 590 | 5 | | 0.75 | 1.85 | 0.95 | 1.35 | ε |
| 21 | m | 590 | 5 | | 0.60 | 1.70 | 0.80 | 1.20 | ε |

TABLE 2-continued

| | | | | | | | | | |
|---|---|---|---|---|---|---|---|---|---|
| 22 | n | 590 | 5 | 3 | 0.95 | 1.70 | 1.15 | 1.45 | ε |
| 23 | o | 590 | 5 | | 0.75 | 1.80 | 0.95 | 1.40 | ε |
| 24 | p | 590 | 5 | | 0.60 | 1.65 | 0.80 | 1.25 | ε |
| 25 | q | 590 | 5 | | 0.80 | 1.80 | 1.00 | 1.35 | ε |
| 26 | a | 590 | 3 | | 0.20 | 1.80 | 0.80 | 1.00 | γ' + ε |
| 27 | a | 590 | 5 | | 0.15 | 1.00 | 0.35 | 0.80 | γ' + ε |
| 28 | a | 590 | 5 | 3 | 0.80 | 3.00 | 1.00 | 1.45 | ε |
| 29 | a | 590 | 5 | 3 | 0.30 | 2.00 | 0.70 | 1.60 | ε |
| 30 | a | 590 | 3 | | 0.65 | 1.50 | 0.10 | 0.90 | γ' + ε |
| 31 | a | 590 | 3 | 3 | 0.35 | 0.90 | 0.20 | 0.65 | ε |
| 32 | r | 590 | 5 | | 0.65 | 1.70 | 0.85 | 1.40 | ε |
| 33 | s | 590 | 3 | | 0.60 | 1.80 | 0.80 | 1.35 | ε |
| 34 | t | 590 | 5 | | 0.40 | 1.85 | 0.80 | 1.50 | ε |
| 35 | u | 590 | 3 | | 0.60 | 1.65 | 0.80 | 1.35 | ε |
| 36 | v | 590 | 5 | | 0.70 | 1.55 | 0.65 | 1.00 | γ' + ε |
| 37 | w | 590 | 3 | | 0.60 | 1.85 | 0.80 | 1.35 | ε |
| 38 | x | 590 | 3 | | 0.30 | 1.95 | 0.70 | 1.45 | ε |
| 39 | y | 590 | 5 | | 0.60 | 1.80 | 0.80 | 1.35 | ε |
| 40 | z | 590 | 3 | | 0.60 | 1.45 | 0.70 | 1.10 | γ' + ε |

| Test no. | Thickness of compound layer (μm) | Hardness of compound layer (HV) | Concentration of compound layer (C + N) (atm %) | Ratio of porous layer (%) | Wear depth (μm) | Pitting strength MPa | Remarks |
|---|---|---|---|---|---|---|---|
| 1 | 13 | 780 | 25 | 8 | 13 | 1950 | Inv. |
| 2 | 20 | 770 | 26 | 7 | 12 | 1900 | ex. |
| 3 | 22 | 790 | 25 | 7 | 12 | 1850 | |
| 4 | 15 | 800 | 25 | 6 | 11 | 1800 | |
| 5 | 27 | 710 | 27 | 9 | 14 | 2000 | |
| 6 | 28 | 690 | 27 | 9 | 15 | 1950 | |
| 7 | 23 | 820 | 27 | 5 | 9 | 1850 | |
| 8 | 22 | 730 | 25 | 6 | 11 | 1850 | |
| 9 | 12 | 750 | 24 | 7 | 13 | 2100 | |
| 10 | 13 | 760 | 23 | 9 | 14 | 2050 | |
| 11 | 10 | 700 | 22 | 8 | 14 | 2000 | |
| 12 | 25 | 780 | 26 | 6 | 12 | 1900 | |
| 13 | 24 | 740 | 26 | 6 | 10 | 1950 | |
| 14 | 11 | 720 | 23 | 7 | 11 | 2050 | |
| 15 | 16 | 810 | 24 | 5 | 9 | 1850 | |
| 16 | 11 | 830 | 23 | 4 | 8 | 1800 | |
| 17 | 15 | 710 | 26 | 6 | 13 | 1950 | |
| 18 | 25 | 760 | 28 | 8 | 14 | 2050 | |
| 19 | 22 | 800 | 26 | 7 | 10 | 2000 | |
| 20 | 19 | 840 | 25 | 5 | 9 | 1850 | |
| 21 | 18 | 710 | 24 | 7 | 12 | 1950 | |
| 22 | 29 | 690 | 29 | 9 | 14 | 1900 | |
| 23 | 22 | 680 | 26 | 9 | 15 | 2100 | |
| 24 | 13 | 810 | 23 | 4 | 9 | 1850 | |
| 25 | 18 | 730 | 23 | 5 | 10 | 1900 | |
| 26 | 18 | 630 | 20 | 7 | 25 | 2100 | Comp. |
| 27 | 10 | 650 | 19 | 9 | 31 | 2200 | ex. |
| 28 | 28 | 530 | 24 | 20 | 29 | 1700 | |
| 29 | 33 | 650 | 26 | 19 | 18 | 1700 | |
| 30 | 12 | 620 | 19 | 4 | 35 | 2300 | |
| 31 | 9 | 660 | 18 | 7 | 16 | 1750 | |
| 32 | 20 | 790 | 23 | 5 | 13 | 1700 | |
| 33 | 9 | 730 | 24 | 6 | 16 | 1600 | |
| 34 | 20 | 690 | 24 | 6 | 11 | 1650 | |
| 35 | 18 | 750 | 23 | 7 | 16 | 1650 | |
| 36 | 18 | 630 | 24 | 7 | 18 | 1950 | |
| 37 | 15 | 710 | 25 | 8 | 12 | 1700 | |
| 38 | 20 | 700 | 24 | 8 | 23 | 1650 | |
| 39 | 18 | 710 | 24 | 8 | 13 | 1750 | |
| 40 | 10 | 640 | 21 | 6 | 21 | 1800 | |

*Underlines indicate outside range of present invention.

Test Nos. 1 to 25 are examples of the nitriding and soft nitriding of the present invention. After the nitriding and soft nitriding, the C-cross-section of each plate shaped test piece (drawing direction) was polished to a mirror finish, etched by a 3% Nital solution for 20 to 30 seconds, then measured for thickness of the compound layer and the volume ratio of the pores by SEM.

The compound layer was photographed at 2000×. From five fields of the photograph of the structure (field area: $2.4\times10^2$ $\mu m^2$), the thicknesses of five points of the compound layer were measured at 10 μm intervals. The average value of the total 25 points was obtained as the compound thickness. Furthermore, 50 μm line segments parallel to the surface were drawn every 2 μm from the surfacemost part to the bottommost part of the compound layer, the ratios of length including the pores in the line segments were calculated using the following formula (2), and the average value of the five fields was used as the volume ratio of the pores.

Volume ratio of pores (%)=Length including pores (μm)/50 (μm)×100 formula (2)

Further, a cross-section polisher was used to polish the C-cross-section and an SEM (scan type electron microscope) was used to photograph the structure. The EBSD attached to the SEM was used to judge the phases formed in the compound layer. The compound layer was photographed at 2000×. Using five fields in the photograph of structure (field area: $2.4\times10^2$ μm$^2$), 50 μm line segments parallel to the surface were drawn every 2 μm from the surface most part to the bottommost part of the compound layer, and the ratios of the length in the line segments where the CI value of $Fe_{2-3}N$ was 0.05 or less were calculated using the following formula (3). The case where the average value of five fields was less than 10% was judged to be the ε single phase.

Length where CI value of $Fe_{2-3}N$ is 0.05 or less (μm)/50 (μm)×100 formula (3)

Next, the Vicker's hardness was measured by the following method based on the "Vicker's Hardness Test—Test Method" in JIS Z 2244 (2003). That is, the average value of 10 points of Vicker's hardness at positions near the center of the compound layer in the thickness direction was defined as the hardness of the compound layer. The hardness of the compound layer was measured with a test load of $9.8\times10^{-2}$N. The Vicker's hardness (HV) was measured at 10 points of each field and the average of the total 50 points was obtained.

Figure 2:
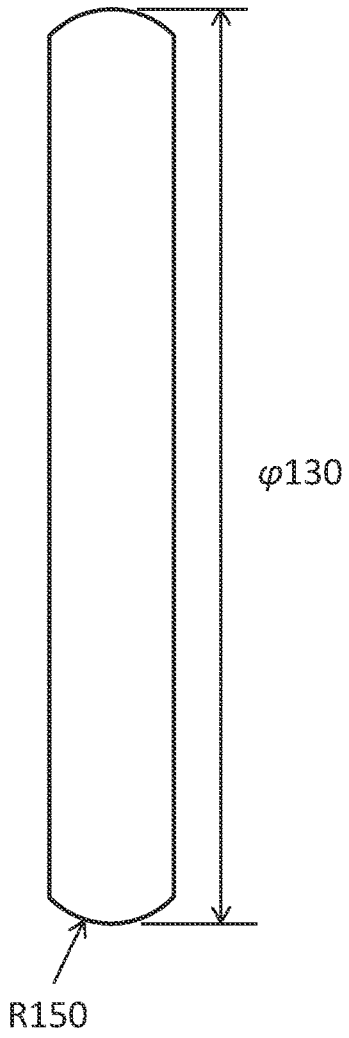
FIG. 2 is a view showing the shape of a large roller used for a roller pitting test. Note that the units of the dimensions ϕ130 and R150 in the figure are "mm".

Next, a small roller for roller pitting test use was finally worked at the grip part for the purpose of relieving the heat treatment strain, then was used as a roller pitting test piece. The shape after the final processing is shown in FIG. 1. The roller pitting test was performed under the conditions shown in Table 3 by a combination of the above small roller for roller pitting test use and a large roller for roller pitting test use of the shape shown in FIG. 2. Note that, the units of the dimensions in FIGS. 1 and 2 are "mm". The large roller for roller pitting test use was prepared using steel satisfying the standard of SCM420 of JIS and the general production process, that is, "normalizing→formation of test piece→eutectoid carburization by a gas carburizing furnace→low temperature tempering→polishing". The Vicker's hardness Hv at a position of 0.05 mm from the surface, that is, a position of 0.05 mm depth, was 740 to 760, while the depth with a Vicker's hardness Hv of 550 or more was a range of 0.8 to 1.0 mm.

Table 3 shows the test conditions when evaluating the wear depth. The test was stopped after a repeated $2\times10^6$ cycles. A roughness meter was used to run the wear part of the small roller along the main shaft direction then measure the maximum wear depth. The number N was made 5 to calculate the average value of the wear depth. The parts of the present invention were formed targeting a wear depth of 15 μm or less.

TABLE 3

| | |
|---|---|
| Test machine | Roller pitting test machine |
| Test piece size | Small roller: diameter 26 mm<br>Large roller: diameter 130 mm<br>Contact part 150 mmR |
| Surface pressure | 1600 MPa |
| Number of tests | 5 |
| Slip ratio | 0% |
| Small roller speed | 1500 rpm |
| Circumferential speed | Small roller: 1.36/sec<br>Large roller: 1.36/sec |
| Lubrication oil | Type: automatic transmission oil<br>Oil temperature: 90° C. |

Further, Table 4 shows the test conditions for evaluation of the pitting strength. The test cutoff was made $10^7$ showing the fatigue limit of general steel. The maximum surface pressure when the number of tests reached $10^7$ without pitting occurring in the small roller test piece was defined as the fatigue limit of the small roller test piece. Pitting was detected by a vibration meter attached to the test machine. After vibration occurred, the rotations of both the small roller test piece and large roller test piece were made to stop. The occurrence of pitting and speed were confirmed. In the parts of the present invention, a maximum surface pressure at the fatigue limit of 1800 MPa or more was targeted.

TABLE 4

| | |
|---|---|
| Test machine | Roller pitting test machine |
| Test piece size | Small roller: diameter 26 mm<br>Large roller: diameter 130 mm<br>Contact part: 150 mmR |
| Surface pressure | 1800 MPa |
| Number of tests | 5 |
| Slip ratio | −40% |
| Small roller speed | 1500 rpm |
| Circumferential speed | Small roller: 1.36/sec<br>Large roller: 2.18/sec |
| Lubrication oil | Type: automatic transmission oil<br>Oil temperature: 90° C. |

The results are shown in Table 2. From Table 2, in Test Nos. 1 to 25 satisfying all of the conditions prescribed in the present invention, it is clear that the amount of wear and the pitting strength both reach the targets and good wear resistance and pitting resistance were obtained. Further, in the tests using steel containing at least one of Mo, V, Cu, and Ni as well, both the amounts of wear and pitting strengths reached the targets and it is clear that both excellent wear resistance and pitting resistance were obtained. On the other hand, Test Nos. 26 to 40 outside the conditions prescribed in the present invention are comparative examples. It is clear that either or both of the wear resistance and pitting resistance do not reach the target. Test Nos. 26, 27, 30, 36, and 40 are examples where ε single phases are not formed, but this is because the amount of C in the steel was not satisfied or the $K_N$ value was low or both were not satisfied. Test Nos. 28 and 29 are examples where the upper limit of the KN value during treatment became too high, so the ε phase became too large in thickness or cavity volume ratio. Test No. 31 is an example of a ε single phase material satisfying the above thickness and cavity volume ratio, but where the KN value during the treatment was too low, so the amount of (C+N) in the ε phase was low and the hardness was insufficient. Test Nos. 32 to 39 are examples where the chemical components of the steel are not optimized.

INDUSTRIAL APPLICABILITY

The gas nitrided part and gas soft nitrided part of the present invention are excellent in wear resistance and pitting resistance, so can be utilized for the transmission parts of automobiles or industrial machines etc.

The invention claimed is:

1. A nitrided part or soft nitrided part made of a steel material comprising, by mass %, C: 0.05 to 0.3%,
Si: 0.05 to 1.5%,
Mn: 0.2 to 1.5%,
P: 0.025% or less,
S: 0.003 to 0.05%,
Cr: 0.5 to 2.0%, Al: 0.01 to 0.05%, and N: 0.003 to 0.025% and having a balance of Fe and impurities, wherein, the surface layer comprises a compound layer containing iron, nitrogen, and carbon and a nitrogen diffusion layer positioned below the compound layer, said compound layer consists of an ε single phase, said ε single phase has a thickness of 8 to 30 μm and a Vicker's hardness of 680HV or more, and said ε single phase has a volume ratio of pores of less than 10%.

2. The nitrided part or soft nitrided part according to claim 1, wherein said compound layer includes, by atm %, (C+N)=22% or more.

3. A method of nitriding a part comprising a steel material having the components according to claim 1, comprising heating the part in a gas atmosphere comprising $NH_3$, $H_2$, and $N_2$ to 550 to 620° C. for 1.0 to 10 hours, wherein a nitriding potential $K_N$ obtained by the following (formula 1) is 0.3 to 2.0 in minute 0 to 50 in said nitriding time and is 0.70 to 1.50 from minute 50 on:

$$K_N=(NH_3 \text{ partial pressure})/[(H_2 \text{ partial pressure})^{3/2}] \quad \text{(formula 1).}$$

4. A method of soft nitriding a part comprising a steel material having the components according to claim 1, comprising heating the part in a gas atmosphere comprising $NH_3$, $H_2$, $N_2$, and $CO_2$ to 550 to 620° C. for 1.0 to 10 hours, wherein a nitriding potential $K_N$ obtained by the following (formula 1) is 0.3 to 2.0 in minute 0 to 50 in said soft nitriding time and is 0.70 to 1.50 from minute 50 on:

$$K_N=(NH_3 \text{ partial pressure})/[(H_2 \text{ partial pressure})^{3/2}] \quad \text{(formula 1).}$$

5. The nitrided part or soft nitrided part according to claim 1, further containing, by mass %, one or both of Mo: 0.01 to less than 0.50% and V: 0.01 to less than 0.50%.

6. The nitrided part or soft nitrided part according to claim 5, further containing, by mass %, one or both of Cu: 0.01 to less than 0.50% and Ni: 0.01 to less than 0.50%.

7. The nitrided part or soft nitrided part according to claim 5, wherein said compound layer includes, by atm %, (C+N)=22% or more.

8. A method of nitriding a part comprising a steel material having the components according to claim 5, comprising heating the part in a gas atmosphere comprising $NH_3$, $H_2$, and $N_2$ to 550 to 620° C. for 1.0 to 10 hours, wherein a nitriding potential $K_N$ obtained by the following (formula 1) is 0.3 to 2.0 in minute 0 to 50 in said nitriding time and is 0.70 to 1.50 from minute 50 on:

$$K_N=(NH_3 \text{ partial pressure})/[(H_2 \text{ partial pressure})^{3/2}] \quad \text{(formula 1).}$$

9. A method of soft nitriding a part comprising a steel material having the components according to claim 5, comprising heating the part in a gas atmosphere comprising $NH_3$, $H_2$, $N_2$, and $CO_2$ to 550 to 620° C. for 1.0 to 10 hours, wherein a nitriding potential $K_N$ obtained by the following (formula 1) is 0.3 to 2.0 in minute 0 to 50 in said soft nitriding time and is 0.70 to 1.50 from minute 50 on:

$$K_N=(NH_3 \text{ partial pressure})/[(H_2 \text{ partial pressure})^{3/2}] \quad \text{(formula 1).}$$

10. The nitrided part or soft nitrided part according to claim 1, further containing, by mass %, one or both of Cu: 0.01 to less than 0.50% and Ni: 0.01 to less than 0.50%.

11. The nitrided part or soft nitrided part according to claim 10, wherein said compound layer includes, by atm %, (C+N)=22% or more.

12. A method of nitriding a part comprising a steel material having the components according to claim 10, comprising heating the part in a gas atmosphere comprising $NH_3$, $H_2$, and $N_2$ to 550 to 620° C. for 1.0 to 10 hours, wherein a nitriding potential $K_n$ obtained by the following (formula 1) is 0.3 to 2.0 in minute 0 to 50 in said nitriding time and is 0.70 to 1.50 from minute 50 on:

$$K_N=(NH_3 \text{ partial pressure})/[(H_2 \text{ partial pressure})^{3/2}] \quad \text{(formula 1).}$$

13. A method of soft nitriding a part comprising a steel material having the components according to claim 10, comprising heating the part in a gas atmosphere comprising $NH_3$, $H_2$, $N_2$, and $CO_2$ to 550 to 620° C. for 1.0 to 10 hours, wherein a nitriding potential $K_N$ obtained by the following (formula 1) is 0.3 to 2.0 in minute 0 to 50 in said soft nitriding time and is 0.70 to 1.50 from minute 50 on:

$$K_N=(NH_3 \text{ partial pressure})/[(H_2 \text{ partial pressure})^{3/2}] \quad \text{(formula 1).}$$

* * * * *